US011149916B1

(12) United States Patent
Dong et al.

(10) Patent No.: US 11,149,916 B1
(45) Date of Patent: Oct. 19, 2021

(54) LIGHTING APPARATUS WITH COMPACT SIZE

(71) Applicant: XIAMEN ECO LIGHTING CO. LTD., Xiamen (CN)

(72) Inventors: Yongzhe Dong, Xiamen (CN); Xiaoliang Wen, Xiamen (CN); Shouqiang Hou, Xiamen (CN); Zhenyu Tang, Xiamen (CN); Yu Zhai, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/852,465

(22) Filed: Apr. 18, 2020

(51) Int. Cl.

| | |
|---|---|
| ***F21V 3/02*** | (2006.01) |
| ***F21V 23/00*** | (2015.01) |
| ***F21V 31/00*** | (2006.01) |
| ***F21V 15/01*** | (2006.01) |
| ***F21V 29/70*** | (2015.01) |
| ***F21S 8/00*** | (2006.01) |
| ***F21V 23/04*** | (2006.01) |
| ***F21V 33/00*** | (2006.01) |
| ***F21Y 103/33*** | (2016.01) |

(52) U.S. Cl.
CPC ..... *F21V 3/02* (2013.01); *F21S 8/00* (2013.01); *F21V 15/01* (2013.01); *F21V 23/001* (2013.01); *F21V 23/003* (2013.01); *F21V 23/007* (2013.01); *F21V 23/0471* (2013.01); *F21V 29/70* (2015.01); *F21V 31/005* (2013.01); *F21V 33/0056* (2013.01); *F21Y 2103/33* (2016.08)

(58) Field of Classification Search
CPC ..... F21V 3/02; F21V 23/001; F21V 23/003; F21V 23/006; F21V 23/007; F21V 23/009; F21V 23/0471; F21V 15/01; F21V 29/70; F21V 31/005; F21V 33/0052; F21V 33/0056; F21S 8/00; F21Y 2103/33
See application file for complete search history.

(56) References Cited

U.S. PATENT DOCUMENTS

| | | | | |
|---|---|---|---|---|
| 10,151,470 | B2 * | 12/2018 | Ghasabi | F21V 23/009 |
| 2014/0268799 | A1 * | 9/2014 | Stolte | F21V 29/507 362/294 |
| 2016/0323972 | A1 * | 11/2016 | Bora | F21V 7/00 |
| 2016/0334082 | A1 * | 11/2016 | Chen | G08B 13/19697 |
| 2017/0167695 | A1 * | 6/2017 | Erdener | F21V 19/02 |
| 2017/0321874 | A1 * | 11/2017 | Bryant | F21V 29/74 |
| 2018/0320882 | A1 * | 11/2018 | Jenson | F21V 29/83 |
| 2019/0041572 | A1 * | 2/2019 | Dahlen | F21V 19/0015 |
| 2019/0049080 | A1 * | 2/2019 | Danesh | F21S 8/02 |
| 2019/0195479 | A1 * | 6/2019 | Bonne | F21V 23/06 |
| 2019/0323691 | A1 * | 10/2019 | Winters | F21V 5/04 |
| 2020/0260181 | A1 * | 8/2020 | Taibi | F21V 33/0056 |

* cited by examiner

*Primary Examiner* — Alan B Cariaso
(74) *Attorney, Agent, or Firm* — Chun-Ming Shih; Lanway IPR Services

(57) ABSTRACT

The lighting apparatus has a main housing, a first light source, a driver module and a top cover. The main housing has a ring part and a central part. The ring part has an external wall and an internal wall. The internal wall surrounds the central part. The external wall has a tilt curve side profile. A bottom of the external wall is connected to a bottom of the internal wall and forms a ring container space. The first light source is surrounded by the internal wall of the main housing. The drive module is disposed in the ring container space. The top cover at least partially conceals the ring container space.

19 Claims, 8 Drawing Sheets

LIGHTING APPARATUS WITH COMPACT SIZE

FIELD

The present application is related to a lighting apparatus and more particularly related to a lighting apparatus with flexible container.

BACKGROUND

Electroluminescence, an optical and electrical phenomenon, was discover in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

SUMMARY

A lighting apparatus is provided. The lighting apparatus has a main housing, a first light source, a driver module and a top cover. The main housing has a ring part and a central part. The ring part has an external wall and an internal wall. The internal wall surrounds the central part. The external wall has a tilt curve side profile. A bottom of the external wall is connected to a bottom of the internal wall and forms a ring container space. The first light source is surrounded by the internal wall of the main housing. The drive module is disposed in the ring container space. The top cover at least partially conceals the ring container space.

In some embodiments, the ring part has a circular shape.

In some other embodiments, the ring part may have other symmetric geometrical shapes, e.g. a rectangular shape or hexagonal shape.

The top cover may be used as an installation base and fixed to a ceiling first. The top cover may have some fixing structures corresponding to a fixing structure of the main housing; therefore, the main housing may be fixed to the ceiling.

The top cover may be made of metal material so as to help heat dissipation of the first light source and the driver module.

The top cover may have wiring holes or sockets for connecting to an external wire. The external wall is electrically connected to the driver module for supplying an external power source like 110V alternating current to the driver module. The driver module converts the external power source to a driving current to the first light source and/or other modules.

In some embodiments, the main housing is made as an unibody module. Specifically, the ring part and the central part are made together, e.g. from a molding procedure.

In some embodiments, the ring container space has multiple slots. The slots are capable of installing function modules in addition to the driver module.

In some embodiments, there is a slot socket for supplying an internal power. The internal power is provided by the driver module to an installed module.

In some embodiments, a speaker module is disposed in one slot for creating sound from the lighting apparatus.

In some embodiments, a heat sink module is inserted into one slot for carrying away heat. The heat is generated by the first light source and the driver module.

In some embodiments, the driver module is divided into multiple driver parts. The driver parts have similar weight and less than 30% difference. The driver parts are disposed in multiple slots to keep weights of different parts of the lighting apparatus being balanced.

In some embodiments, the driver module and the first light source are integrated as a module. The module is directly placed to the main housing.

In some embodiments, the lighting apparatus has a second light source. The second light source is disposed in the ring container space.

In some embodiments, the second light source is a circular light bar. The circular light bar emits light from the external wall of the ring part.

In some embodiments, the second light source has multiple spotlights. The spotlights are disposed to the external wall of the ring part.

In some embodiments, the first light source is a waterproof module. The first light source is attached to the central part of the main housing.

In some embodiments, there is a driver electrode. The driver electrode is on the internal wall. The driver electrode provides electricity to the first light source from the driver module.

In some embodiments, there is a sensor integrated to the first light source. The sensor collects data. The data is supplied to the driver module.

In some embodiments, the sensor is a motion sensor. The motion sensor detects a motion of an object nearby.

In some embodiments, the top cover is made of metal material. The top cover is attached to the central part of the main housing to carry away heat. The heat is generated by the first light source.

In some embodiments, the ring part is rotatable with respect to the first light source for changing a setting of the driver module. For example, a color temperature, a color or enabling or disabling a function and/or other settings. The setting may be transmitted to the driver module to adjust controlling. The adjustment is in line with the relative rotation angle between the ring part and the central part of the main housing.

In some embodiments, the first light source module is rotated with respect to the main housing for changing the settings of the driver module.

In some embodiments, a rotation between the ring part and the first light source module changes a distance between a lens and LED modules of the first light source. The change of distance changes a light beam angle of an output light beam.

In some embodiments, there is an extended terminal. The extended terminal connects to another lighting apparatus and provides electricity of the driver module to another lighting apparatus.

In some embodiments, there is an extended wire. The extended wire is collectable to the ring part. The extended wire is used for connecting to another lighting apparatus.

In some embodiments, the extended wire is mounted with a second light source.

In some embodiments, the ring container space has multiple slots being capable of installing function modules in addition to the driver module;

In some embodiments, there is a slot socket for supplying an internal power provided by the driver module to an installed module.

In some embodiments, a speaker module is disposed in one slot for creating sound from the lighting apparatus.

In some embodiments, a heat sink module is inserted into one slot for carrying away heat of the first light source and the driver module.

In some embodiments, the driver module is divided into multiple driver parts with similar weight with difference less than 30% disposed in multiple slots to keep weights of different parts of the lighting apparatus being balanced.

In some embodiments, the driver module and the first light source are integrated as a module to be placed to the main housing directly.

In some embodiments, the lighting apparatus may also include a second light source disposed in the ring container space.

In some embodiments, the second light source is a circular light bar emitting light from the external wall of the ring part.

In some embodiments, the second light source includes multiple spot lights disposed to the external wall of the ring part.

In some embodiments, the first source is a water proof module to be attached to the central part of the main housing.

In some embodiments, there is a driver electrode on the internal wall providing electricity to the first light source from the driver module.

In some embodiments, there is a sensor integrated to the first light source for collecting data supplied to the driver module.

In some embodiments, the sensor is a motion sensor for detecting a motion of an object nearby.

In some embodiments, the top cover is made of metal material and attached to the central part of the main housing to carry away heat of the first light source.

In some embodiments, the ring part is rotatable with respect to the first light source for changing a setting of the driver module In some embodiments, a rotation between the ring part and the first light source module changes a distance between a lens to LED modules of the first light source to change a light beam angle of an output light beam.

In some embodiments, there is an extended terminal for connecting to another lighting apparatus for providing electricity of the driver module to the another lighting apparatus.

In some embodiments, there is an extended wire collectable to the ring part when necessary, the extended wire is used for connecting to the another lighting apparatus.

In some embodiments, the extended wire is mounted with a second light source.

DETAILED DESCRIPTION

Figure 1:
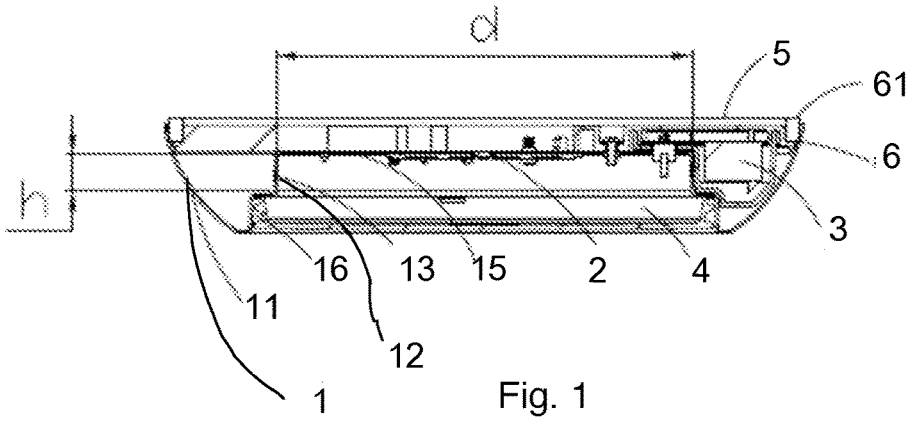
FIG. 1 illustrates an embodiment of a lighting apparatus.
Figure 2:
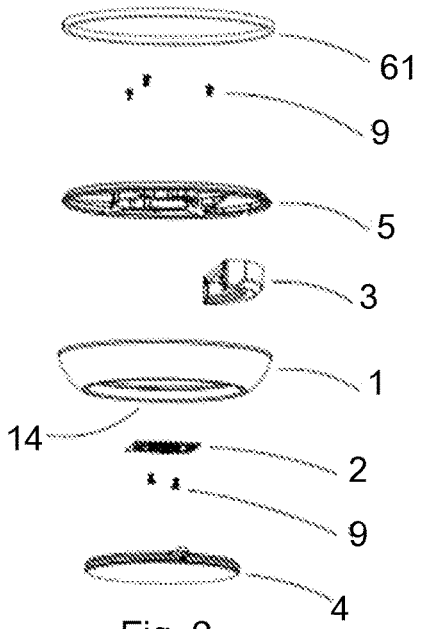
FIG. 2 illustrates an exploded view of the embodiment in FIG. 1.

Please refer to FIG. 1 and FIG. 2. A lighting apparatus is provided. The lighting apparatus has a reflector 1, a light source 2, a driver module 3, a light passing cover 4 and a back cover 5. The reflector 1 has an external tube 11 and a reflection cup 12 disposed in the external tube 11. The external tube 11 and the reflection cup 12 are made as an unibody structure. The reflection cup 12 has a reflection portion 13. An end of the reflection portion 13 being away from the back cover 5 is light opening 14. The external tube 11 and the reflection cup 12 are connected as an unibody at the light opening 14. The light source 2 is installed in the reflection cup 12. The light passing cover 4 is installed at the light opening 14. The light passing cover 4 is made of transparent or translucent optical materials to emit even light. The back cover 5 is set on the end of the external tube 11 being against the light opening 14. The back over 5 is capable of being fixed by a screw 9. The driver module 3 is used for controlling the light source 2. The driver module 3 is set between the reflection cup 12 and the back cover 5. The driver module is capable of being installed on the back cover 5, or the back side or lateral side of the reflection cup 12 to lower the overall height of the light, and further to save the packaging cost.

In this embodiment, the reflector 1 is made as the unibody structure of the external tube 11 and the reflection cup 12. The driver module 3 is installed in the space defined by the reflection cup 12, the external tube 11 and the back cover 5 to simplify the structure of the lighting apparatus.

In this embodiment, the driver module 3 is capable of being set between the reflection cup 12 and the back cover 5, or between the reflection cup 12 and the external tube 11. The utilization of the space defined by the reflection cup 12 and the external tube 11 is capable of lowering the overall height of the lighting apparatus.

Figure 3:
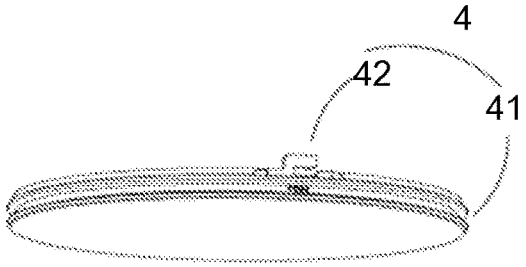
FIG. 3 shows a diffusion cover in the embodiment of FIG. 1.

In this embodiment, please refer to FIG. 1 and FIG. 3. The reflection cup 12 has an installation part 16 used for installing the light passing cover 4. The light opening 14 is formed between the installation part 16 and the reflection portion 13. The light passing cover 4 is capable of being installed on the installation part 16 with a screw structure 41 or a buckle structure 42. There is corresponding screw structure 41 or buckle structure 42 on the installation part 16 and the light passing cover 4.

Or, the screw structure 41 and the buckle structure 42 are capable of directly joining. A waterproof function of the lighting apparatus is capable of being achieved by the screw structure 41 or the buckle structure 42. In this embodiment, the external tube 11 and the reflection cup 12 are capable of being connected as a body at the installation part 16.

In order to prevent the screw structure 41 or the buckle structure 42 of the light passing cover 4 or the reflection cup 12 from declining the transmission of the light, in this embodiment, the diameter of the installation part 16 is longer than the diameter of the light opening 14 to ensure the light passing through the light passing cover 4 is even.

The diameter of the light opening 14 is d. The distance between the light passing cover 4 and the light source 2 is h. in order to increase the evenness of the light and improve the illumination effect, the ratio d/h is set to be ≥5.0. In this embodiment, both the evenness and the utilization rate of the light are increased.

In order to reduce the size of the refection cup 12, and to further reduce the size of the lighting apparatus, the light source 2 is installed on the center of the bottom surface 15 of the reflection cup 12. The light emitted from the light source 2 partially emits directly to the light passing cover 4 while partially reflects to the light passing cover 4 through the reflection portion 13 of the reflection cup 12 and emits even light through the light passing cover 4. Meanwhile, the light source 2 is installed on the bottom surface 15 of the reflection cup 12 to fulfill the need of heat dissipation. The light source 2 is capable of being installed on the bottom surface 15 of the reflection cup 12 with the screw 9. In this embodiment, the distance between the light passing cover 4 and the light source 2 is capable of being seen as the distance between the light passing cover 4 and the bottom surface 15 of the reflection cup 12.

In this embodiment, the size of the cross section of the externa tube 11 narrows from the end that is near the back cover 5 to the end of the light opening 14. The size of the cross section of the reflection portion 13 broadens from the end being near the back cover 5 to the end of the light opening 14. Therefore, there is a larger space defined by the reflection cup 12, the back cover 5 and the external tube 11 narrowing along the direction of the light opening 14. The larger space is capable of setting the driver module 3, and further lower the overall height and the occupied space of the lighting apparatus.

In this embodiment, the external tube 11 is a ball platform. The ball platform refers to the portion between two parallel planes formed by the intersection of balls. Being the shape of ball platform, the external tube 11 is convex outward and has larger inner space to place the driver module 3.

In order to enhance the waterproof effect of the lighting apparatus, an edge of the back cover 5 and the external tube form a concave groove 6. There is a concealing ring 61 installed at the concave groove 6. The concealing ring 61 seals the gap between the edge of the back cover 5 and the external tube 11 to enhance the waterproof effect.

In this embodiment, the driver module 3 is capable of being adjusted. Therefore, the light and color of the lighting apparatus are capable of being adjusted.

Figure 4:
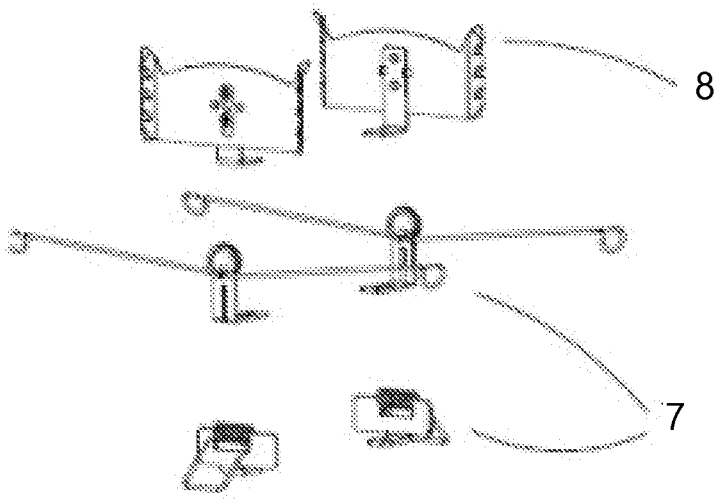
FIG. 4 illustrates fixing components in the example of FIG. 1.

More particularly, the reflector 1 connects to a spring module 7 or an elastic spring module 8. The spring module 7 or the elastic spring module 8 are used for installing the lighting apparatus to the installation box, standard installation tube and ceiling. Please refer to FIG. 4 to see the structure of the spring module 7 or the elastic spring module 8.

Figure 5:
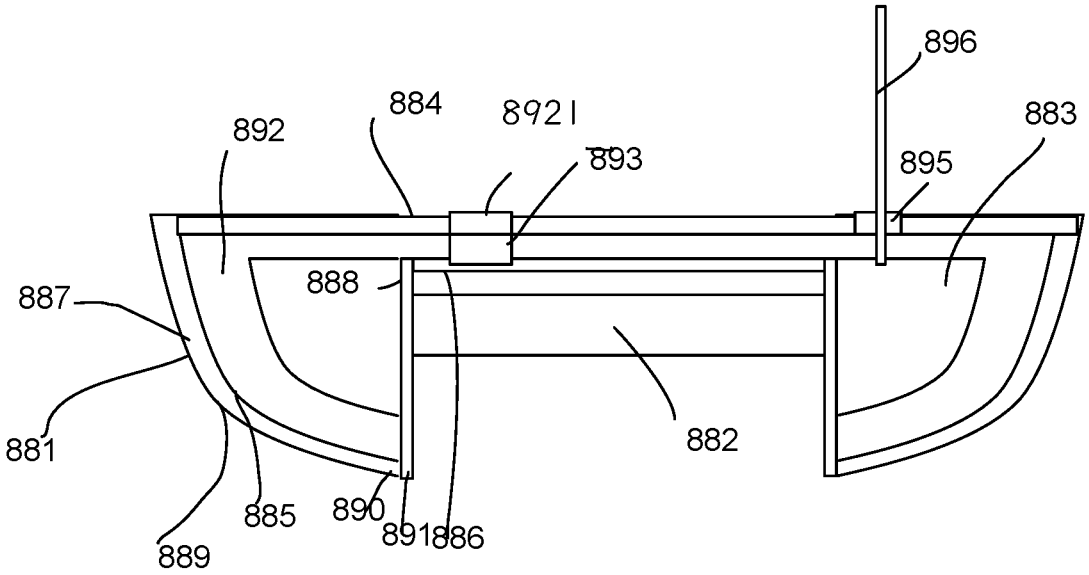
FIG. 5 illustrates a structure view of an embodiment.

In FIG. 5, a lighting apparatus is provided. The lighting apparatus has a main housing 881, a first light source 882, a driver module 883 and a top cover 884. The main housing 881 has a ring part 885 and a central part 886. The ring part 885 has an external wall 887 and an internal wall 888. The internal wall 888 surrounds the central part 886. The external wall 887 has a tilt curve side profile 889. A bottom 890 of the external wall 887 is connected to a bottom 891 of the internal wall 888 and forms a ring container space 892. The first light source 882 is surrounded by the internal wall 888 of the main housing 881. The driver module 883 is disposed in the ring container space 892. The top cover 884 at least partially conceals the ring container space 892.

In FIG. 5, the ring part has a circular shape. In some other embodiments, the ring part may have other symmetric geometrical shapes, e.g. a rectangular shape or hexagonal shape.

The top cover may be used as an installation base and fixed to a ceiling first. The top cover may have some fixing structures 8921 corresponding to fixing structures 893 of the main housing 881 so that the main housing 881 may be fixed to the ceiling.

The top cover 884 may be made of metal material so as to help heat dissipation of the first light source and the driver module.

The top cover 884 may have wiring holes 895 or sockets for connecting to an external wire 896, which is electrically connected to the driver module 883 for supplying an external power source like 110V alternating current to the driver module 883. The driver module 883 converts the external power source to a driving current to the first light source and/or other modules.

In some embodiments, the main housing 881 is made as a unibody module. Specifically, the ring part 885 and the central part 886 are made together, e.g. from a molding procedure.

In some embodiments, the ring part 885 has a circular shape.

In some other embodiments, the ring part 885 may have other symmetric geometrical shapes, e.g. a rectangular shape or hexagonal shape.

Figure 6:
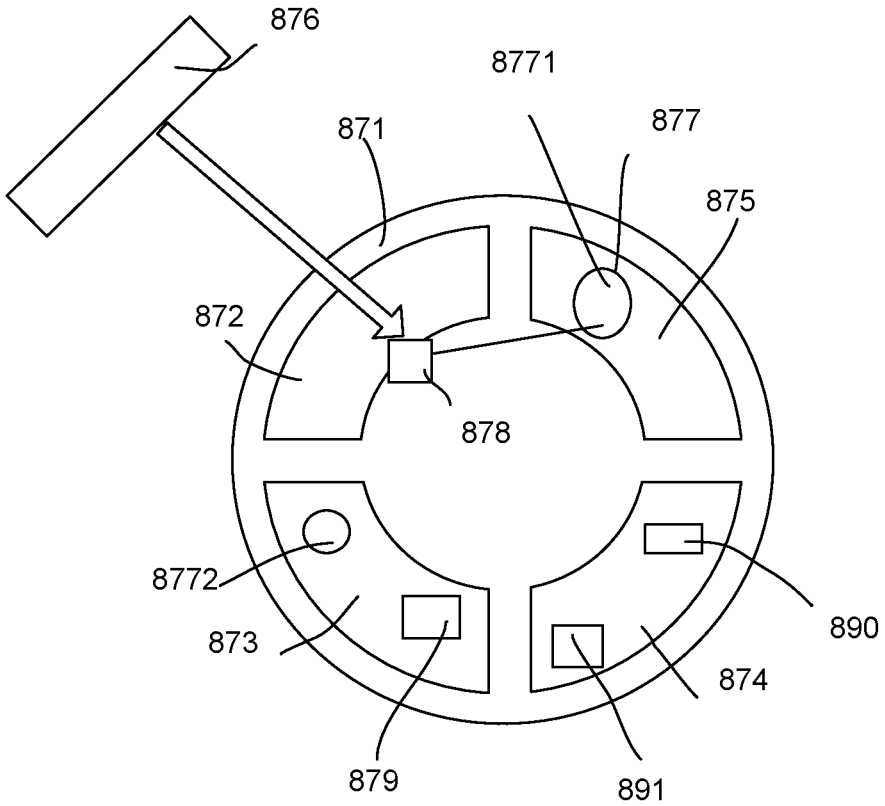
FIG. 6 illustrates another embodiment.

In FIG. 6, the ring container space 871 has multiple slots 872, 873, 874, 875. The slots 872, 873, 874, 875 are capable of installing function modules 876 in addition to the driver module 877.

In FIG. 6, there is a slot socket 878 for supplying an internal power. The internal power is provided by the driver module 875 to an installed module 876.

In FIG. 6, a speaker module 879 is disposed in one slot for creating sound from the lighting apparatus.

In FIG. 6, a heat sink module 890 is inserted into one slot for carrying away heat. The heat is generated by the first light source and the driver module 877.

In some embodiments, the driver module 877 is divided into multiple driver parts 8771, 8772. The driver parts 8771, 8772 have similar weight and less than 30% difference. The driver parts 8771, 8772 are disposed in multiple slots to keep weights of different parts of the lighting apparatus being balanced.

In some embodiments, the driver module and the first light source are integrated as a module. The module is directly placed to the main housing.

In FIG. 6, the lighting apparatus has a second light source 891. The second light source 891 is disposed in the ring container space.

In some embodiments, the second light source is a circular light bar. The circular light bar emits light from the external wall of the ring part.

Figure 7:
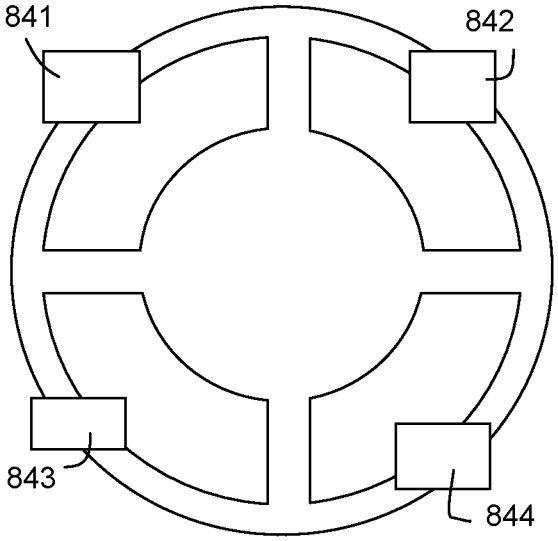
FIG. 7 illustrates another embodiment.

In FIG. 7, the second light source has multiple spotlights. The spotlights 841, 842, 843, 844 are disposed to the external wall of the ring part.

Figure 8:
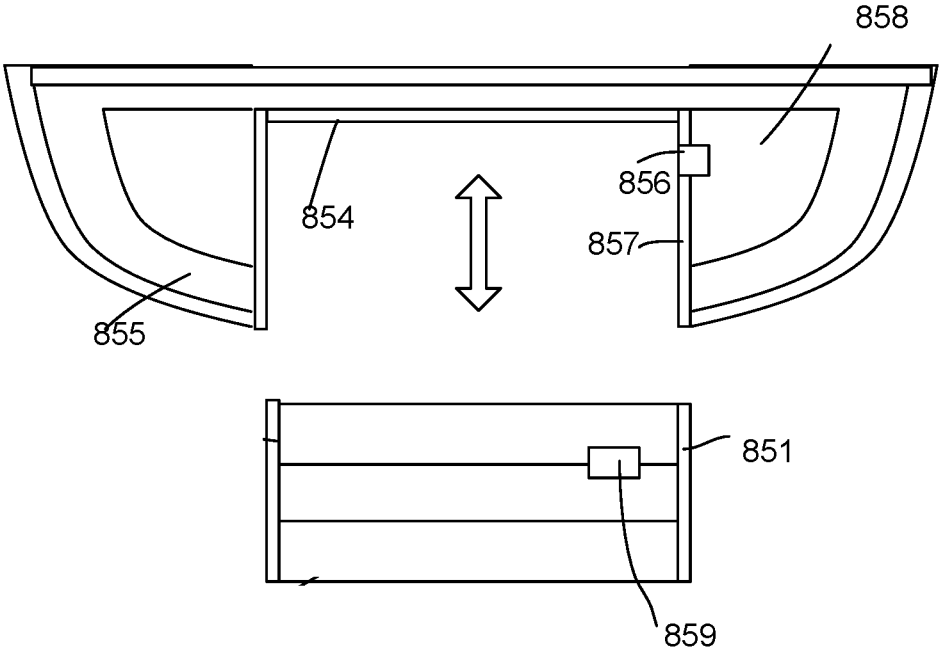
FIG. 8 illustrates another embodiment.

In FIG. 8, the first light source is a waterproof module 851. The waterproof module 851 is attached to the central part 854 of the main housing 855.

In FIG. 8, there is a driver electrode 856. The driver electrode 856 is on the internal wall 857. The driver electrode 856 provides electricity to the first light source of the waterproof module 851 from the driver module 858.

In FIG. 8, there is a sensor 859 integrated to the first light source. The sensor collects data. The data are supplied to the driver module 858.

In some embodiments, the sensor is a motion sensor. The motion sensor detects a motion of an object nearby.

In some embodiments, the top cover is made of metal material. The top cover is attached to the central part of the main housing to carry away heat. The heat is generated by the first light source.

Figure 9:
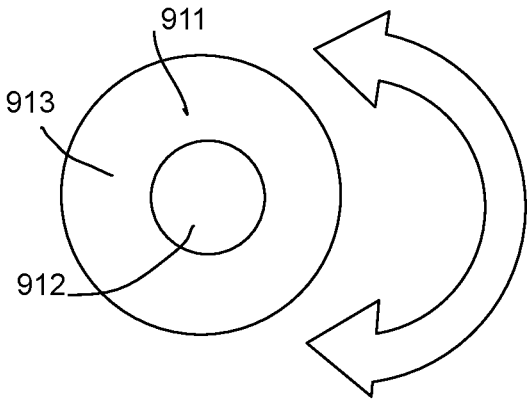
FIG. 9 illustrates another embodiment.

In FIG. 9, the ring part 911 is rotatable with respect to the first light source 912 for changing a setting of the driver module. For example, a color temperature, a color or enabling or disabling a function and/or other settings. The setting may be transmitted to the driver module to adjust controlling. The adjustment is in line with the relative rotation angle between the ring part and the central part of the main housing.

In FIG. 9, the first light source module 912 is rotated with respect to the main housing 913 for changing the settings of the driver module.

Figure 10:
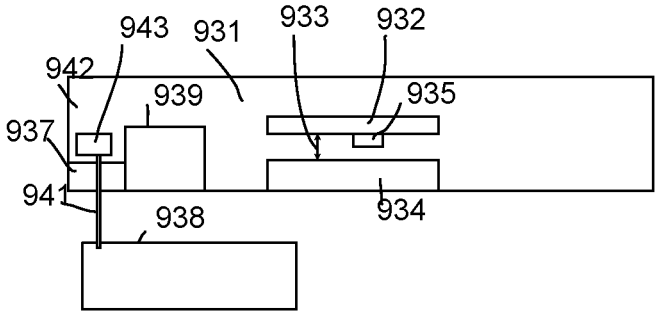
FIG. 10 illustrates another embodiment.

In FIG. 10, a rotation between the ring part 931 and the first light source module 932 changes a distance 933 between a lens 934 and LED modules 935 of the first light source 932. The change of distance changes a light beam angle of an output light beam.

In FIG. 10, there is an extended terminal 937. The extended terminal 937 connects to another lighting apparatus 938 and provides electricity of the driver module 939 to another lighting apparatus 938.

In FIG. 10, there is an extended wire 941. The extended wire 941 is collectable to the ring part. The extended wire 941 is used for connecting to another lighting apparatus 938.

In FIG. 10, the extended wire 941 is connected with a second light source 943.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a main housing having a ring part and a central part, the ring part having an external wall and an internal wall, the internal wall surrounding the central part, the external wall having a tilt curve side profile and a bottom of the external wall being connected to a bottom of the internal wall and forming a ring container space;

a first light source being surrounded by the internal wall of the main housing;

a driver module being disposed in the ring container space; and a top cover at least partially concealing the ring container space, wherein the driver module is divided into multiple driver parts with similar weight with difference less than 30% disposed in multiple slots to keep weights of different parts of the lighting apparatus being balanced.

2. The lighting apparatus of claim 1, wherein the ring container space has multiple slots being capable of installing function modules in addition to the driver module.

3. The lighting apparatus of claim 2, wherein there is a slot socket for supplying an internal power provided by the driver module to an installed module.

4. The lighting apparatus of claim 2, wherein a speaker module is disposed in one slot for creating sound from the lighting apparatus.

5. The lighting apparatus of claim 1, wherein a heat sink module is inserted into one slot for carrying away heat of the first light source and the driver module.

6. The lighting apparatus of claim 1, wherein the driver module and the first light source are integrated as a module to be placed to the main housing directly.

7. The lighting apparatus of claim 1, further comprising a second light source disposed in the ring container space.

8. The lighting apparatus of claim 7, wherein the second light source is a circular light bar emitting light from the external wall of the ring part.

9. The lighting apparatus of claim 7, wherein the second light source comprises multiple spot lights disposed to the external wall of the ring part.

10. The lighting apparatus of claim 1, wherein the first source is a water proof module to be attached to the central part of the main housing.

11. The lighting apparatus of claim 10, wherein there is a driver electrode on the internal wall providing electricity to the first light source from the driver module.

12. The lighting apparatus of claim 1, wherein there is a sensor integrated to the first light source for collecting data supplied to the driver module.

13. The lighting apparatus of claim 12, wherein the sensor is a motion sensor for detecting a motion of an object nearby.

14. The lighting apparatus of claim 1, wherein the top cover is made of metal material and attached to the central part of the main housing to carry away heat of the first light source.

15. The lighting apparatus of claim 1, wherein the ring part is rotatable with respect to the first light source for changing a setting of the driver module.

16. The lighting apparatus of claim 15, wherein a rotation between the ring part and the first light source module changes a distance between a lens to LED modules of the first light source to change a light beam angle of an output light beam.

17. The lighting apparatus of claim 1, wherein there is an extended terminal for connecting to another lighting apparatus for providing electricity of the driver module to said another lighting apparatus.

18. The lighting apparatus of claim 17, wherein there is an extended wire collectable to the ring part when necessary, the extended wire is used for connecting to said another lighting apparatus.

19. The lighting apparatus of claim 18, wherein the extended wire is connected with a second light source.

* * * * *